US007328601B1

(12) United States Patent
King

(10) Patent No.: US 7,328,601 B1
(45) Date of Patent: Feb. 12, 2008

(54) PRECISION DEGREE PIPE BENDER

(75) Inventor: Franklin H. King, 3950 Coburg Rd., Sp. 34, Eugene, OR (US) 97408

(73) Assignee: Franklin H. King, Eugene, OR (US)

( * ) Notice: Subject to any disclaimer, the term of this patent is extended or adjusted under 35 U.S.C. 154(b) by 19 days.

(21) Appl. No.: 11/444,278

(22) Filed: Jun. 1, 2006

(51) Int. Cl.
*B21D 9/00* (2006.01)

(52) U.S. Cl. ..... 72/369; 72/31.05; 72/459

(58) Field of Classification Search ..... 72/386, 72/459, 387, 461, 31.04, 1.053
See application file for complete search history.

(56) References Cited

U.S. PATENT DOCUMENTS 4,052,881 A * 10/1977 Mount ..... 72/459
6,834,527 B2 * 12/2004 Hopwood ..... 72/459

* cited by examiner

*Primary Examiner*—Derris H. Banks
*Assistant Examiner*—Debra M Wolfe
(74) *Attorney, Agent, or Firm*—Franklin H. King

(57) ABSTRACT

A three version precision degree pipe hand bender using stop members inserted into degree slots cut into a bender head outer periphery to signal pipe bend completion as the pipe being bent touches a stop member.

15 Claims, 11 Drawing Sheets

PRECISION DEGREE PIPE BENDER

BACKGROUND OF THE INVENTION

This invention relates to a hand operated pipe bender. More specifically this invention relates to a hand operated precision degree pipe bender.

There are two types of hand operated pipe benders. These are the Hicky bender and the Bender Head Shoe Bender. The Bender Head is constructed of a mold casting of aluminum or iron.

There are two ways to use the Hicky and Bender Head pipe benders. One is the floor bend method in that the pipe being bent is laid on a flat surface and the hands and a foot are used as the purchase power to bend the pipe. The other method of pipe bending is referred to as air bending. In air bending the outer end of the bender handle is rested on a surface with the bender head in the air. The pipe is held by the hands and pulled into the bender shoe to the angle desired.

The air bending method will be used with this invention to make degree bends.

There are bender shoe heads using such methods as raised rib degree lines on the sides of the bender head. Other hand benders have arrows or level vials as degree indications. Time is lost using rifle style aim sightings of degree lines or adjusting to a level vial.

A faster method of degree indication is needful. This invention provides the means for instant degree indication as well as a precision bend.

In the present used hand benders there is over and under bending, hence adjustment must be made loosing time.

This invention makes precision bends quickly without wows on saddle or sweep bends. In saddle bending the wows are referred to as doglegs that have to be corrected wasting time.

There is no provision for the making of concentric or ⅜$^{th}$ inch box offset bends on the hicky or bender head in use. Box off sets are the ⅜$^{th}$ off-sets at the ends of each pipe run entering an electrical housing, such as a junction box for electrical wiring.

SUMMARY OF THE INVENTION

It is an object of the present invention to provide a pipe hand bender that will allow the user to bend one shot precision degree bends.

Other objects are:

To bend precision degree off-set bends with out the use of a level.

To bend concentric bends.

To place two bend cross marks at a predetermined distance apart on pipe for the bending of ⅜$^{th}$ inch box off-sets.

To mark pipe to be bent with two full lengths opposed center stripes on the longitudinal axis.

NEW ELEMENTS

Figure 1:
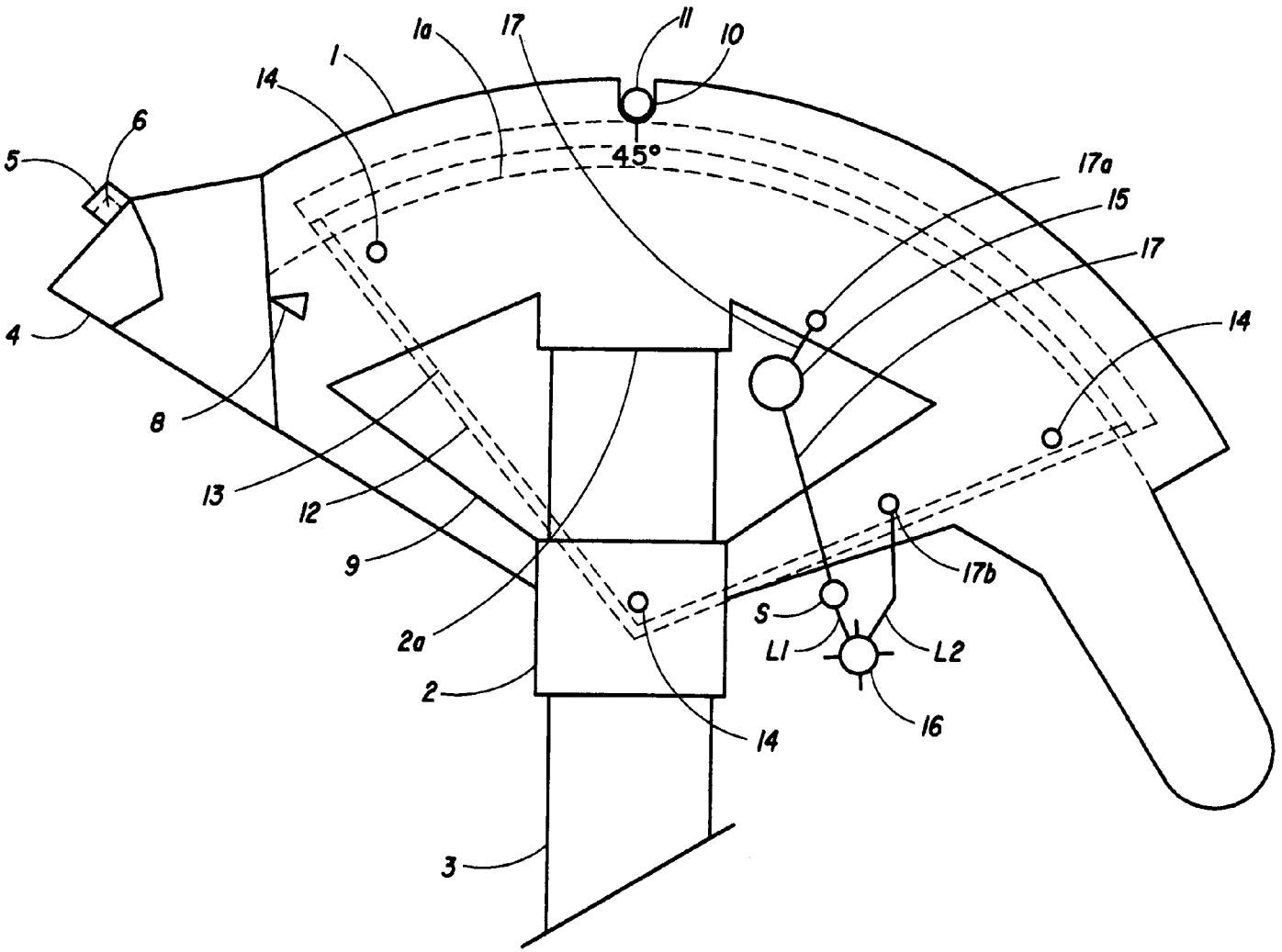
FIG. 1 is a side view of one embodiment of the present precision degree hand pipe bender according to the invention showing a magnetized stop member in a degree slot, and a button battery electrically attached to a signal lamp.
Figure 1B:
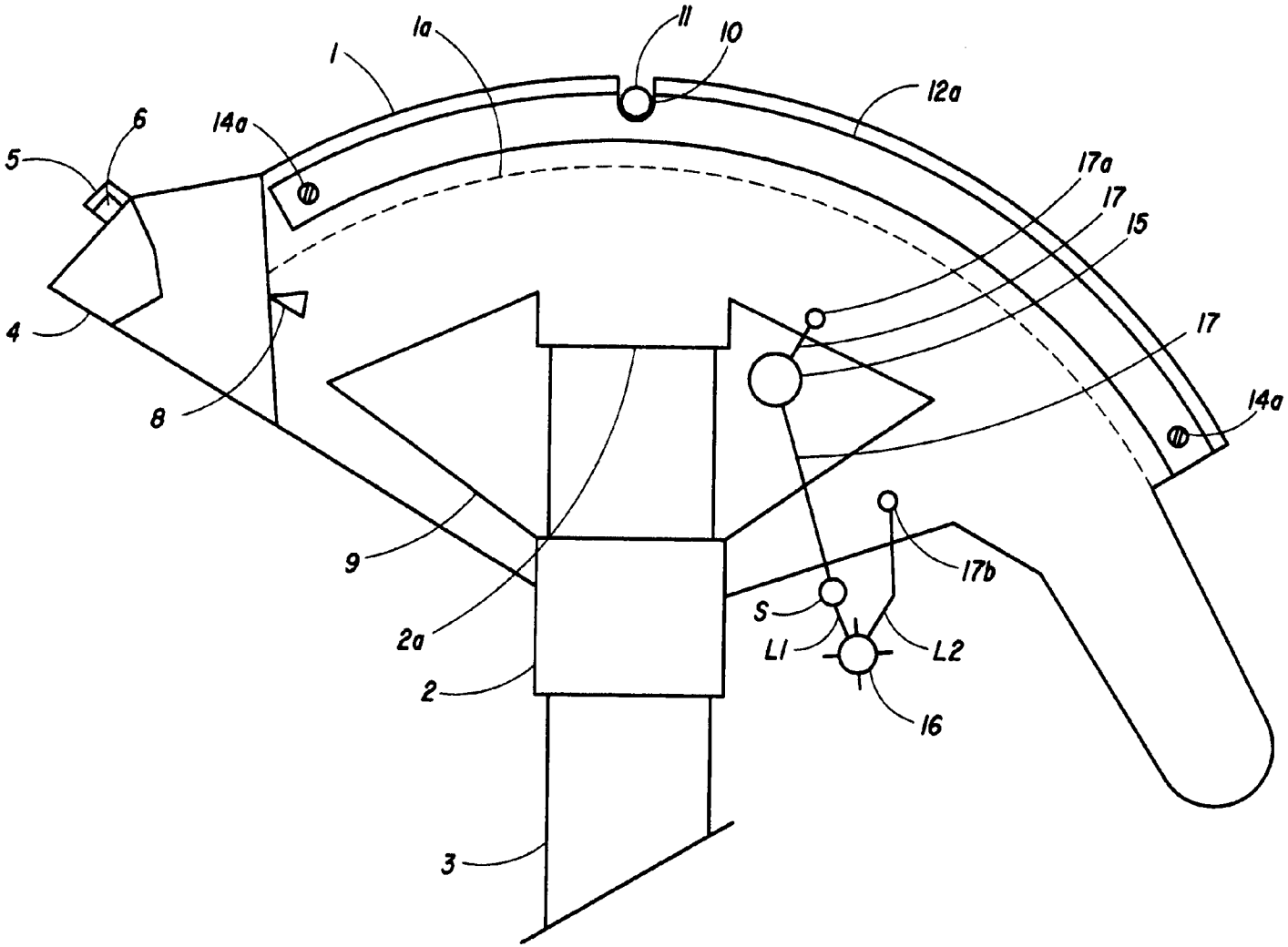
FIG. 1*b* is a side view if FIG. 1, showing a soft iron rainbow bar mounted to a bending trough outer wall.

FIG. 1.-5, 6, 10, 11, 12, 13, 14, 14*a*, 16, 17, 17*a*, 17*b* and S.

FIGS. 1*b*-12*a*, 12*b* and 14*b*.

Figure 2:
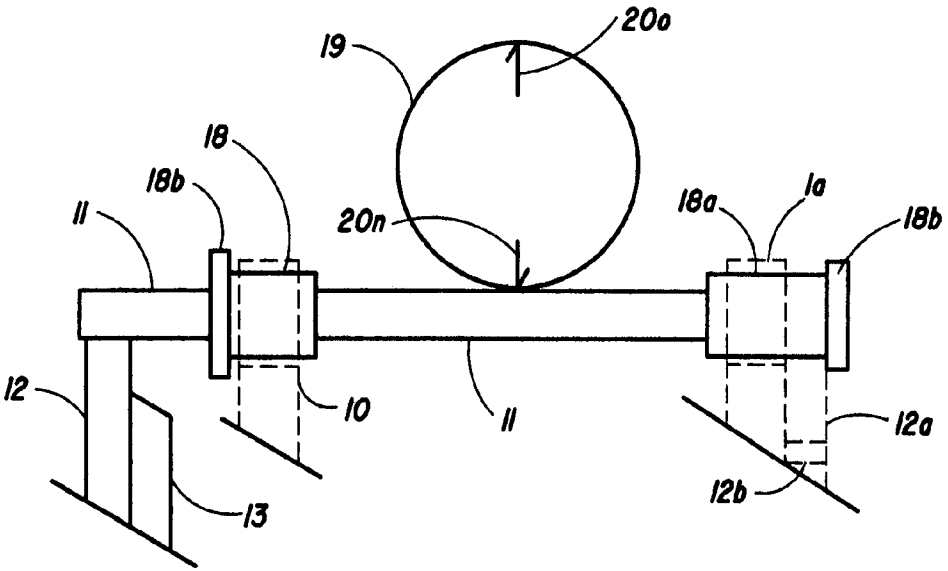
FIG. 2 is an enlarged side view of the magnetized stop member of FIG. 1 showing insulators with centering guides at each end. One bare metal end is touching a soft iron plate and the other end is touching a soft iron rainbow bar. A pipe with two opposed center strips is shown at rest at magnetic neutral mid point of the stop bar.

FIG. 2.-18, 18*a*, 18*b*, 20*o*, old center stripe for new use to center the pipe being bent. Added 20*n*, opposed center strip to eliminate the use of a level to align offset bends.

Figure 3:
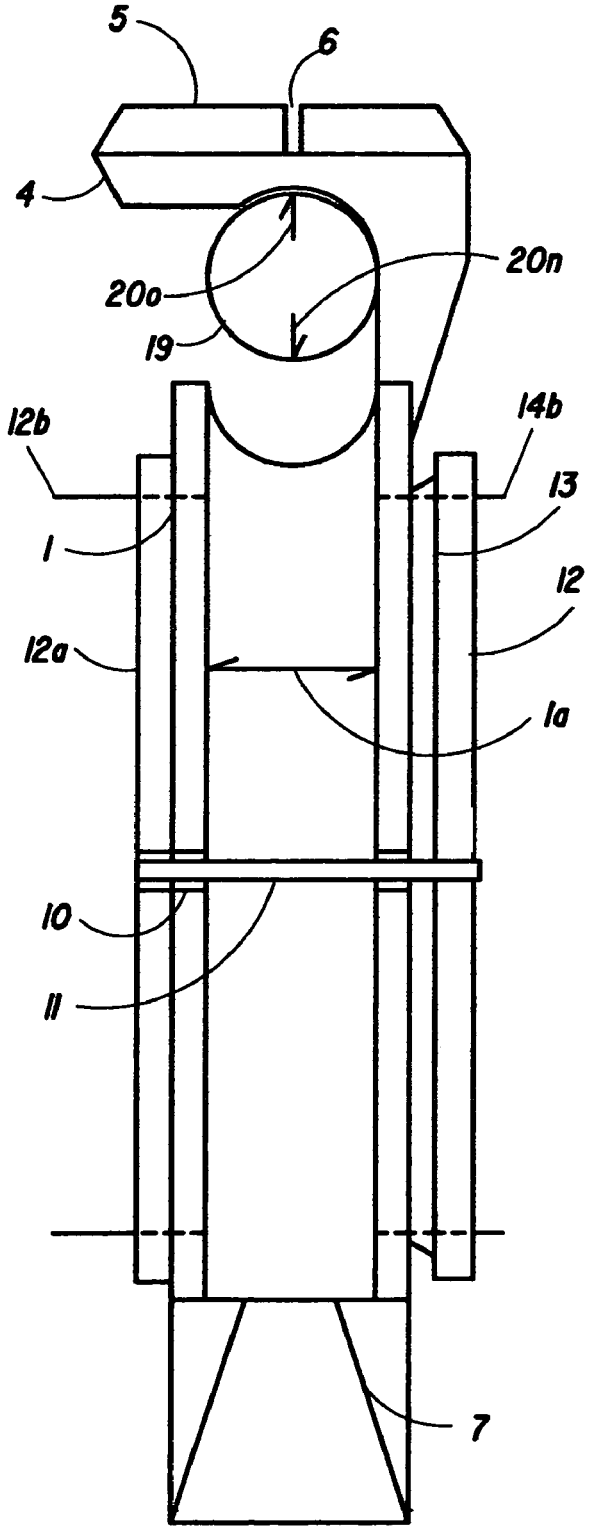
FIG. 3 is a top view of FIG. 1, with an end view of a pipe in place with a center stripe in line with a centering groove and a stop member in matching degree slots without insulators Installed.

FIG. 3.-12*a* and 12*b* and 14*b*

Figure 5:
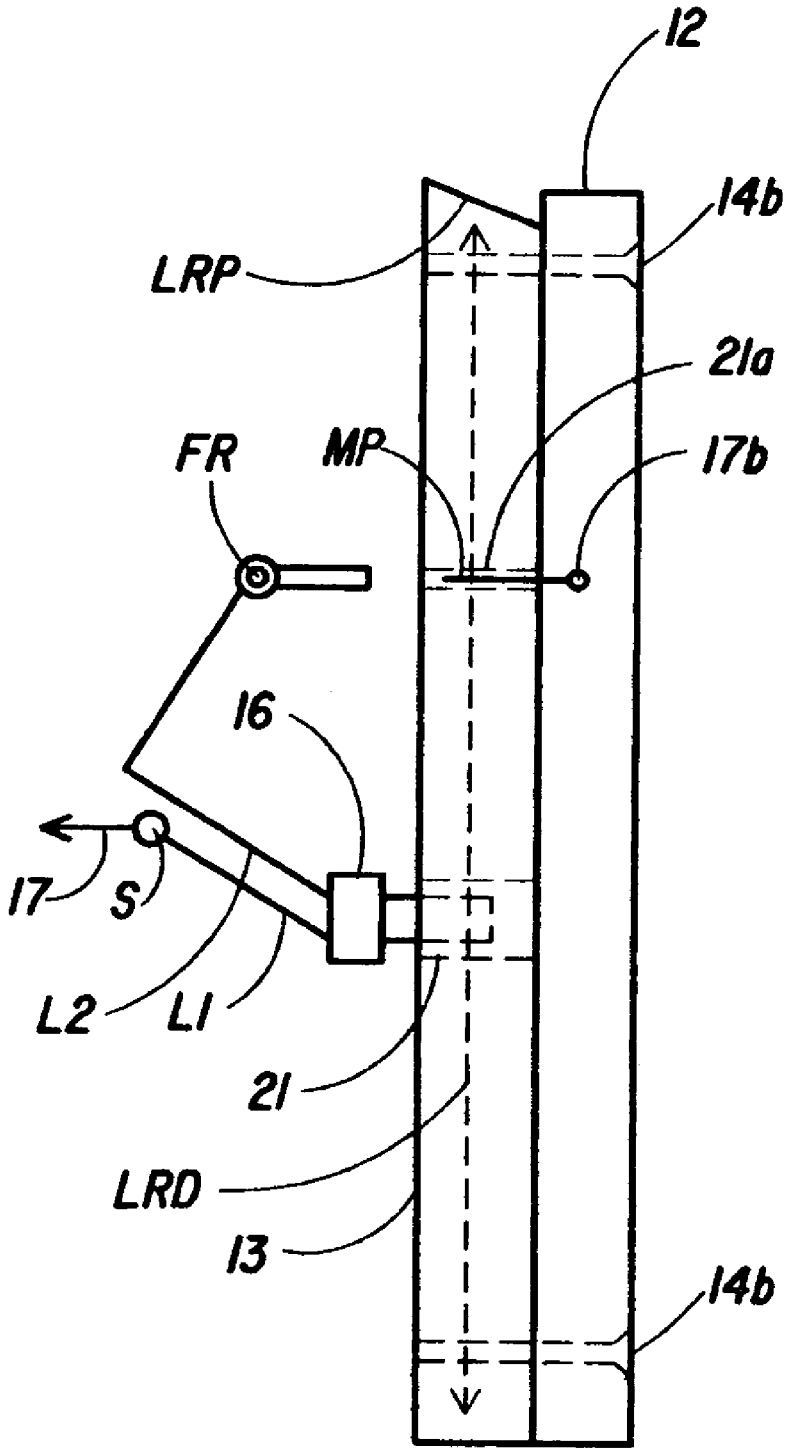
FIG. 5 is a side view of the signal lamp of FIG. 1 in place in a port in a Plexiglas table bonded to A soft iron plate, with circuitry connections.

FIG. 5.-21, 21*a*, FR, LRD, LRP and MP

FIG. 7.-24

FIG. 9.-10*a*

Figure 10:
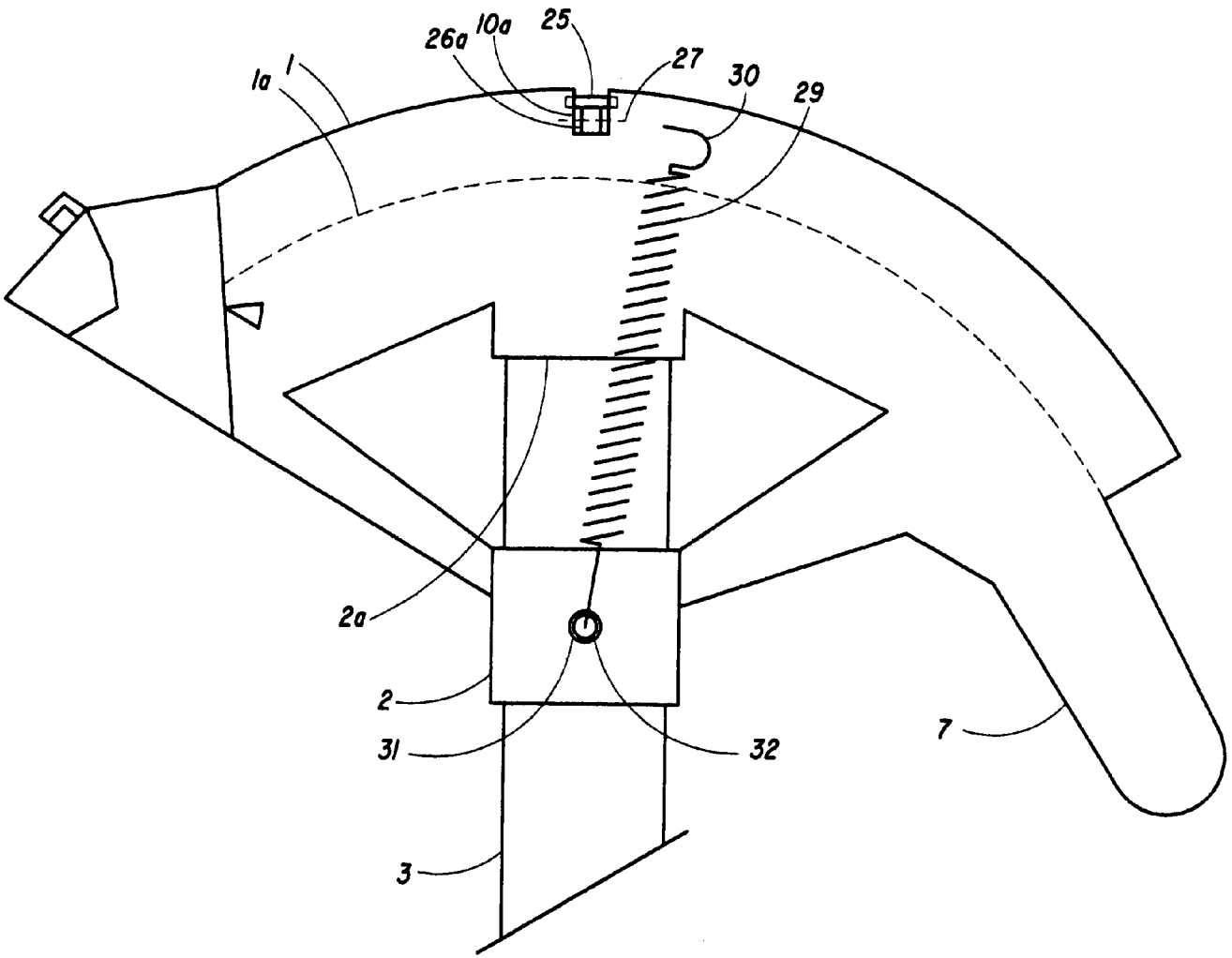
FIG. 10 is a side view of a third embodiment of FIG. 1 bender head showing a stop bar in place in a square degree slot and a tension return coil spring in line to be mounted to the stop bar.

FIG. 10.-29, 30, 31 and 32

Figure 13:
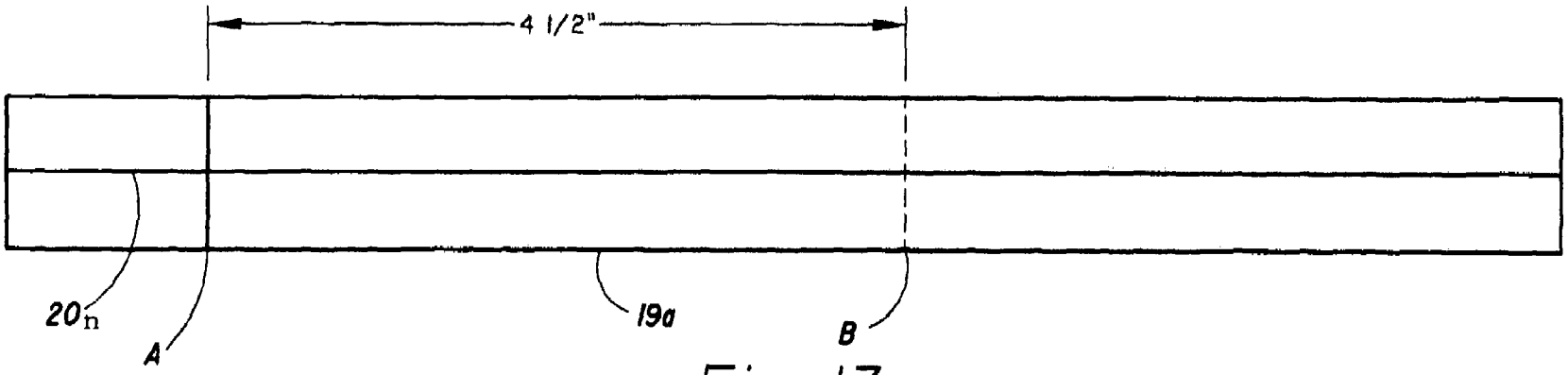
FIG. 13 is a top view of a ½ inch electrical metallic tubing pipe with one of two opposed center Stripe markings and two offset bend cross marks at 4 and ½ inch spacing.

FIG. 13. & 14.—bend cross mark A and B

DESCRIPTION OF THE PREFERRED EMBODIMENTS

The precision degree bender head pipe hand bender of the present invention uses stop members inserted by hand into degree marked slots cut into the outer periphery edges of a bend trough shoe One embodiment uses a lamp to register pipe bend completion. Two other embodiments use pipe to stop member contact pressure to register bend completion.

In essence the present invention incorporates three different embodiment constructions for the bending of precision degree pipe bends. FIG. 1 and two FIG. 1 variations are used. In the various embodiments illustrated in the drawings common parts have common numbers.

FIG. 1 shows a cast metal bender head 1, a bending trough shoe 1*a*, a slide sleeve hub 2, a threaded hub 2*a*, a bending handle 3, a pipe lock down hook 4 with a raised cap bridge 5, having a pipe centering groove 6 cut in line to the bend trough shoe 1*a* longitudinal center, a foot bending lever 7, a bend start arrow 8, two body cavities 9, a concave degree marked slot 10 as typical, a stop pin 11 in a degree slot 10, a soft iron plate 12 in dotted line interposed on a matching Plexiglas plate 13 mounted to the bender head 1 side, hard fiber flat head mounting machine screws 14, a button battery 15 and a light emitting diode signal lamp 16 in exploded suspension outside the bender head 1 body, a button battery ground terminal 17*a*, a button battery lead wire 17 connected to a splice is in turn connected to a leg wire L1 of the light emitting diode signal lamp 16, a leg L2 of the light emitting diode signal lamp 16 connected to a soft iron plate 12 grounded terminal 17*b*.

FIG. 1 a shows a soft iron rainbow bar 12*a* mounted to a side of the bender head 1 bend trough wall of FIG. 1 with hard fiber flat head mounting machine screws 14*a*.

A soft iron plate 12 and a soft iron rainbow bar 12*a* are used only with non-magnetic bender heads.

FIG. 2 Shows an enlarge view of stop pin 11 of FIG. 1 with a center striped pipe 19 at rest at the magnetic neutral mid point. There has been a change in that insulators 18 and 18*a* have centering guides 18*b* formed at the outer edges for centering stop pin 11 in place in matched degree slots 10. The shorter insulator is recessed back of one end of the stop pin 11 with a bare metal end in a magnetic lock down on an upper edge of a soft iron plate 12 edge. This provides an electrical connection for the signal lamp 16 of FIG. 1 bender head 1. The insulator 18*a* is elongated to rest on a soft iron rainbow bar 12*a* upper edge for magnetic lock down completion of the stop pin 11. Internal arrowheads of pipe 19 point to opposed center stripes 20*o* and 20*n* on the external surface. The insulators 18 and 18*a* insulate the stop pin 11 from the body proper of the FIG. 1 bender head 1. An isolated ground is created so current can flow back to the button battery 15; only through a pipe being bent as it touches stop pin 11 bare metal mid point. There would be no need of an extension of insulator 18 or for a rainbow bar 12*a* if a magnetizing bender head 1 were used.

Figure 2A:
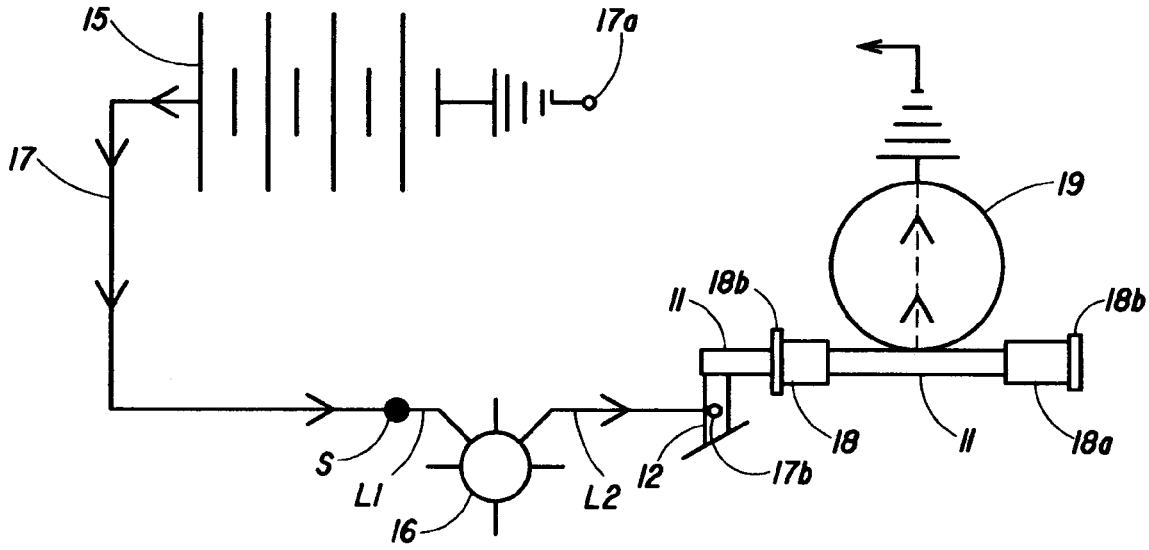
FIG. 2*a* is an electrical schematic print of a pipe bend completion lamp signal circuit.

FIG. 2*a* shows the schematic electrical circuit for the light emitting diode signal lamp 16 of FIG. 1. The arrow heads show the direction of current flow from the positive side of a button battery 15 through a wire 17, to a splice S, through a signal lamp 16 leg L1, through the lamp 16 out the L2, to a terminal 17*b* ground on s soft iron plate 12 into the bare metal end of the stop pin 11, through the bare metal pipe 19 and back to the negative battery terminal 15 to signaling bend completion.

FIG. 3 shows the double center stripe marked pipe 19 mounted under the pipe lock down hook 4 with a center stripe in line with a centering groove 6 ready to be bent. A soft iron plate 12 bonded to a matching Plexiglas plate 13 is shown mounted to a side of the bender head 1 of FIG. 1 by mounting screws 14 through open ports 14*b*. A stop pin 11 without insulators 18 and 18*b* is shown in place in matching cross degree matching slots 10.

Figure 4:
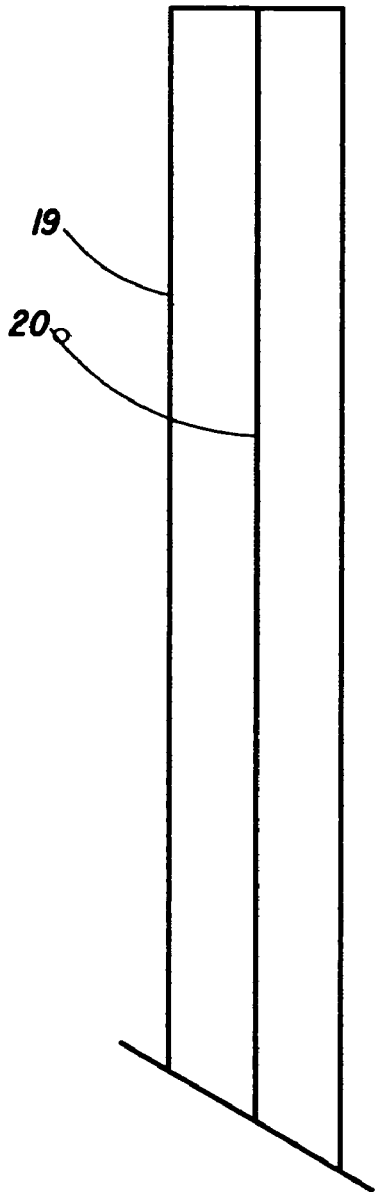
FIG. 4 is a top view of a pipe segment with full-length center stripes.

FIG. 4 shows a double center stripe marked pipe segment 19 with a center stripe 20 on the longitudinal axes.

FIG. 5 shows the soft iron plate 12 mounted to the matching Plexiglas plate 13 ready to be mounted to the FIG. 1 bender head side. The L.E.D. signal lamp 16 electrical components are shown in place. A male prod MP is connected to ground to the soft iron plate 12 at terminal 17*b*. The female receptacle is connected to the leg L2, of the signal lamp 16. The other signal lamp 16 leg L1, is connected to the positive side of the button battery 15 by a lead wire 17 connected to a splice S. The light reflecting direction of the L.E.D. signal lamp 16 is shown by a dotted line double-headed arrow L.R.D. The reflected light strikes the angle cut light reflecting plain LRP, and reflects along the under section at a tangent. This creates a flat plain for the user to easily see. 21*a* is an open port for the mounting of the female receptacle FR.

Figure 6A:
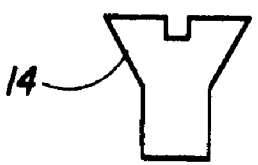
FIG. 6*a* is a side view of the hard fiber flat head machine screw for mounting FIG. 6 embodiments.
Figure 6:
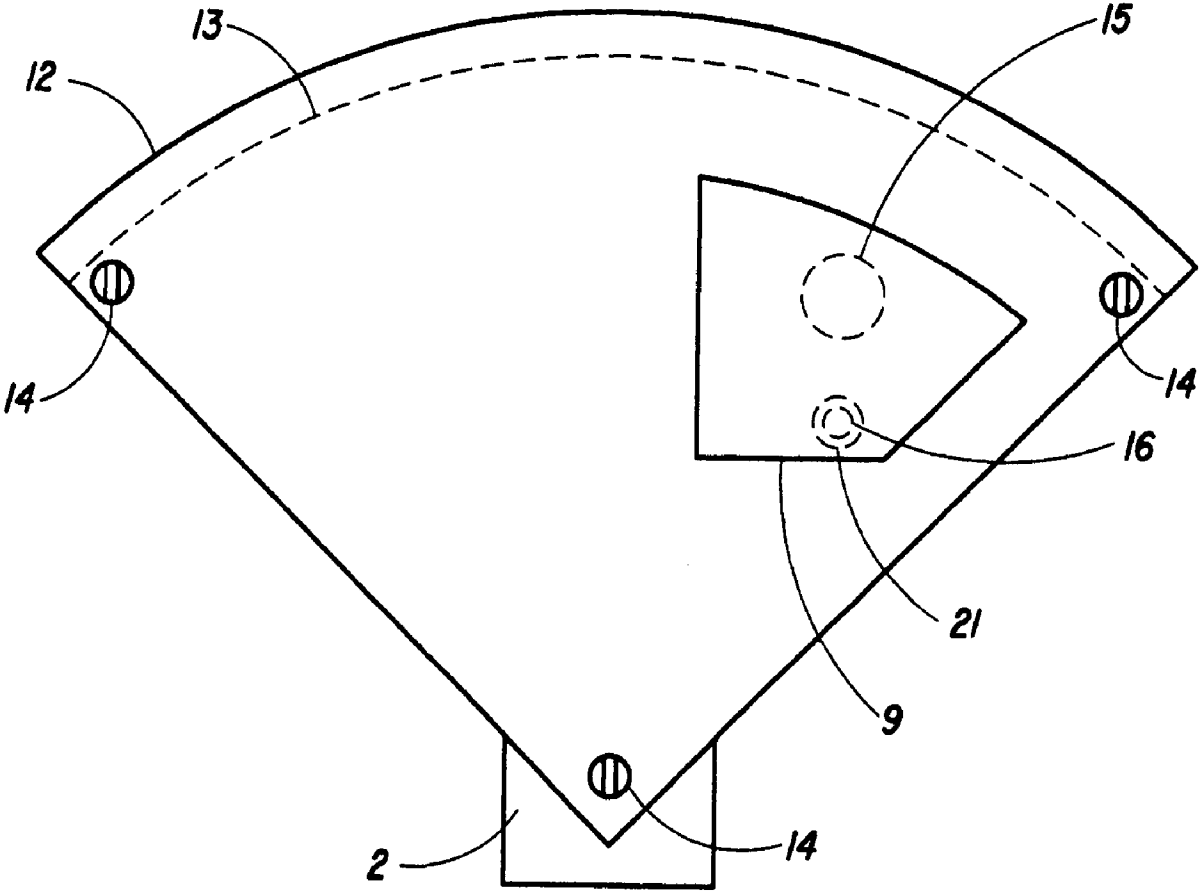
FIG. 6 is a side view of the soft iron plate and a matching Plexiglas plate mounted to a FIG. 1 bender head side and electrical signal components in a bender head cavity.

FIG. 6 shows the mounted position of the soft iron plate 12 and the Plexiglas plate 13 to bender head 1 of FIG. 1. The hard fiber flat head machine screw 14 of FIG. 6*a* is used to mount the soft iron plate 12 and the Plexiglas plate 13 assembly, through open ports 14*b*.

Figure 7:
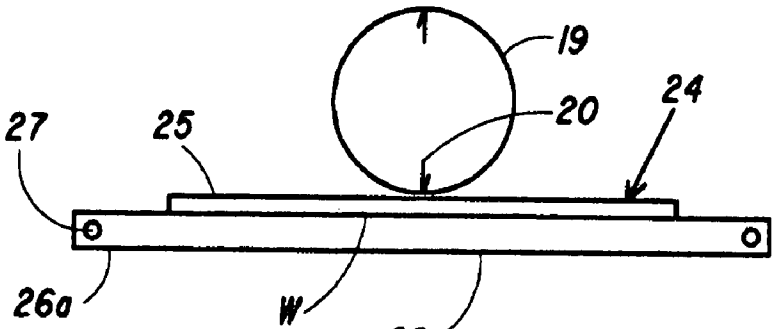
FIG. 7 is a side view of a degree stop bar with a center-striped pipe at rest at mid point

FIG. 7 shows a magnetized stop bar 24 with a rectangular table bar 25 with its center axis welded at right angle to the edge of a slide bar 26. The slide bar 26 ends extend past the table 25 to form slide tab extensions 26*a*. The flat bar 25 acts as an anti-pipe dent entity on over bend.

Figure 8:
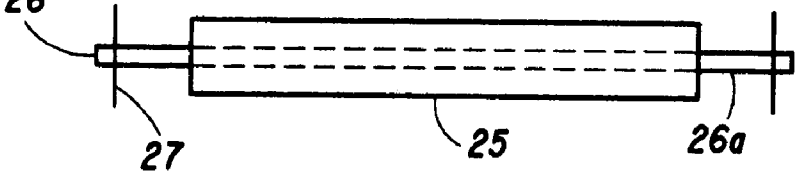
FIG. 8 is a top view of FIG. 7 stop bar.

FIG. 8 shows the table 25 position on the slide bar 26 upper edge, and recessed back from the slide bar 26 ends. This allows insertion into the FIG. 1 bender head 1 trough shoe 1*a*. The stop bar 24 is used with open ports 27 using FIG. 10 bender 1 head embodiment. Another bender head 1 FIG. 9 embodiment uses magnetic stop bars 24 without open ports 27.

Figure 9:
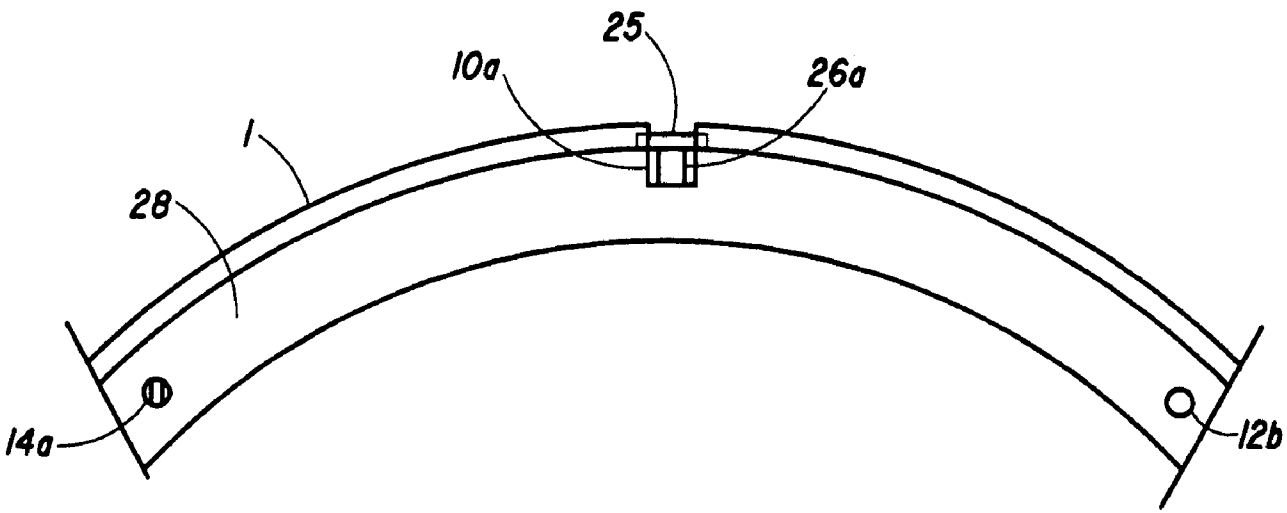
FIG. 9 is a side view of a segment of a second embodiment of the bender head of FIG. 1 with a stop bar at rest in a square cut degree slot and touching a soft iron rainbow bar.
Figure 11:
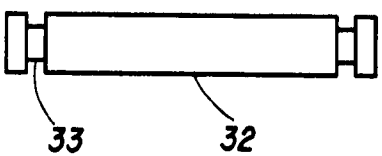
FIG. 11 is a side view of a through pin with spring hook mounting spools at each end.
Figure 12:
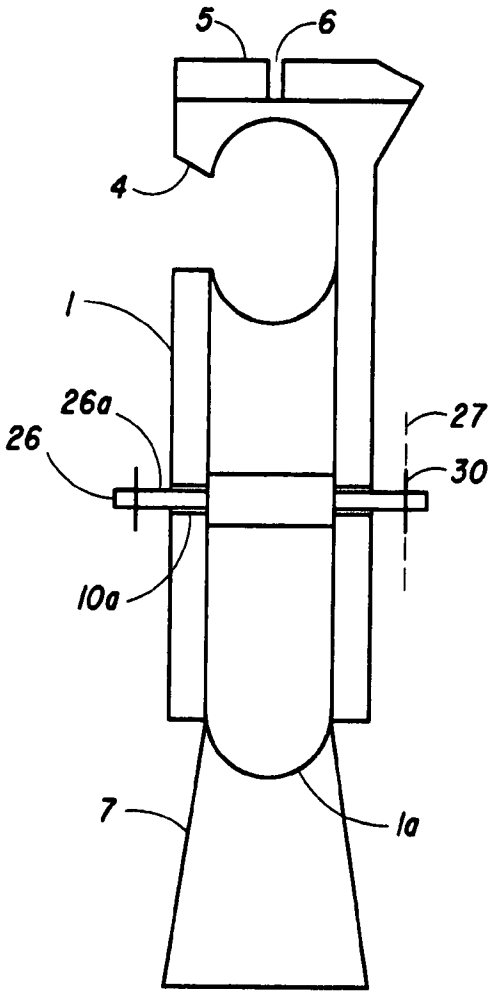
FIG. 12 is a top view of FIG. 10 bender head with a stop bar in place in a square cut degree slot showing the coil spring hooks in place in the stop bar spring mounting open ports.

FIG. 9 shows a second FIG. 1 bender head 1 embodiment with a change in that square cut degree slots 10*a* replace the concave degree slots 10 of FIG. 1. In turn a magnetized stop bar 24 replaces the stop pin 11 of FIG. 1. Metal machine screws 14*a* replace the flat head hard fiber machine screws 14 of FIG. 1. The machine screws 14*a* are used to mount a soft iron rainbow bar 12*a* to both sides of the bender head 1 of FIG. 1. through the mounting open ports 12*b*. A stop bar 24 is placed in a selected square cut degree slot 10*a* where it is held in magnetic lock down to the soft iron rainbow bars 12*a*. A pipe is bent to touch the table 25 of the stop bar 24. Contact pressure signals bend completion FIGS. 10 to 12 show an alternate bender head embodiment to the FIG. 9 drawing with a change in that a coil return spring 29 with end hooks 30 are used to lock down stop bar 24 in the square cut degree slots 10*a* as used in FIG. 9 embodiment. A through pin 32 with hook mounting end cut spool 33 is inserted through a center drilled open port passing through a the slide hub 2 and bend handle 3 of FIG. 10. A tension return spring 29 hook 30 at a lower end is attached to the through pin 32 sleeve 33 and the other hook 30 is shown pulled by hand ready to be hooked to stop bar open port 27. The stop bar 24 in FIG. 10 embodiment is not magnetic.

FIG. 12 shows a stop bar in place in a square cut degree slot 10*a*. A return coil spring 29 is used on either side of the bender head 1, as indicated in FIG. 12. The coil return spring hooks 30 are shown inserted into open ports 27. To use the FIG. 10 version bender the nonmagnetic stop bar is lifted by hand under spring tension and lowered into a square cut degree slot 10*a*. The pipe is bent to touch the table 25 of the stop bar 24. This contact signals bend completion.

Figure 14:
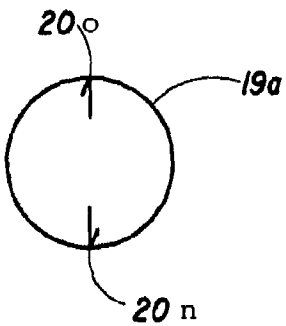
FIG. 14 is an end view of FIG. 13 pipe showing position of the two opposed center stripe external markings.

FIGS. 13 & 14 show a pipe lay out for the bending of a ⅜$^{th}$ inch box offset on a ½ inch electrical metal tubing pipe 19. The lay out would be on a pipe with opposing center stripes 20 as indicated in FIGS. 13 and 14. A first bend cross mark A is placed across the pipe 19 on one side of the pipe and other cross mark B on the other side of the pipe at 4 and ½ inches apart. The FIG. 14 shows the position of the opposed center stripes 20*o* and 20*n* by arrow points

DESCRIPTION OF THE PREFERRED EMBODIMENTS

In use in FIGS. 1 to 14, a bending handle 3 threaded at one end is mounted to a bender head 1. The threaded end of the handle is inserted through a sleeve hub 2 and threaded into a threaded hub 2*a*.

The air bending method will be used to obtain precision degree bends. An example is in the bending of a ⅜$^{th}$ inch box offset on a ½ inch electrical metallic tubing pipe 19. A ½ inch E.M.T. hand bender FIG. 1 will be used. Install a stop pin 11 in a 5 degree slot 10. A ½ inch E.M.T. pipe of FIGS. 13 and 14 will be used. Insert the pipe 19 under a pipe lock down hook 4. Adjust the pipe 19 so the first bend cross mark A is in line with start arrow 8. Revolve the pipe so a center stripe 20 lines up with a centering groove 6 as illustrated in FIG. 3. Bend the pipe to touch the stop pin 11, release the pipe 19 and slide it forward under the pipe lock down hook 4. Repeat the same procedure using the second cross mark B and the other opposed center stripe. This will give a ⅜$^{th}$ inch box offset with out wow and without the use of a level. The bare metal of the pipe 19 touching the bare metal magnetic neutral mid-point of the stop pin 11 switches on the L.E.D. signal lamp 16 indicating bend completion. Lifting the pipe 19 from the bender will not remove the stop bar 24 since the pipe 19 contacts only the non-magnetic neutral area. When a stop bar 24 is used in a square cut degree slot 10*a* of FIG. 9 as a pipe being bent contacts the stop bar 10*a* pressure is felt. This signals bend completion. When the magnetized stop bar 24 is used in a square cut degree slot 10*a*, in a soft iron rainbow bar 12*a* of FIG. 9 it is held in lock down by magnetic pressure. If a FIG. 9 iron bender head 1 is used there is no need of a soft iron rainbow bar since the stop bar 24 would attract to the magnetizing iron square slot 10*a*. The magnetic attraction to the soft iron rainbow bar 28 or slots in an iron bender head holds the stop members in lock down in the respective degree slots. In the FIG. 10 version the non-magnetic stop bar 24 is held in place in a square cut degree slot 10*a*, by tension of a tension return coil spring 29. To use the FIG. 10 version bender head 1 lift the degree stop bar 24 by hand. Line the degree stop bar 24 in line with the selected square cut degree slot 10*a* the tension return spring 29 will pull the stop bar 24 into the selected 10*a* degree slot. Insert a pipe into the bender head 1 and bend pipe to touch the table 25 of the degree stop bar 24. To bend a floor bend with FIG. 1 bender pull the degree stop pin 11 to lock in place behind the foot level 7. The precision degree pipe bender 1 of FIG. 1 is laid out for bending concentric bending by use of a bend formula table (enclosed). The first three degree slots are at 2½, 5 and 10 for concentric bending. The rest of the degree slots would be 15, 22½, 30, 45, 50, 60, 70 and 80 or as the manufacturer desires. Conventional hand benders use degrees of 10, 22½, 30, 45 and 60. The extra new degree slots make for a more versatile way to the bending of pipes.

There has been described a novel pipe bender. It is evident that those skilled in the art may now make numerous uses and modifications and departures from the specific embodiments described herein without departing from the incentive concepts. Consequently the invention is to be construed as embracing each and every feature and novel combination of features present or possessed by the pipe bender herein disclosed and limited solely by the spirit and scope of the appended claims.

The invention claimed is:

1. A manual method of bending pipe comprising:

providing a bender head having an arcuate bending trough shoe having first and second ends, said bender head being formed of an iron containing metal;

locating a plurality of degree marks on said bender head adjacent said arcuate bending trough shoe;

locating slots in the outer periphery of said arcuate bending trough shoe adjacent each of said degree marks;

inserting a stop member into a selected one of said slots and causing said stop member to be held in place in said slot, said stop member being formed of a magnetized metal, said stop member being held in place in said slot by magnetic attraction between said magnetized stop member and said bender head;

selecting a length of pipe to be bent;

placing a first selected portion of said length of pipe in contact with said arcuate bending trough shoe adjacent said first end thereof; and bending said length of pipe towards said arcuate bending trough shoe until said pipe contacts said stop member.

2. The method of claim 1 including providing an electrical circuit that is connected to said stop member, to a power source and to a light bulb, and said pipe is conductive and grounded, said circuit adapted to light said light bulb upon contact between said pipe and said magnetized stop member.

3. The method of claim 2 including selecting a light emitting diode as said light bulb.

4. The method of claim 1 including mounting a soft iron rainbow bar on each side of said arcuate bending trough shoe, said soft iron rainbow bar being adapted to contact said stop member in said slot whereby said stop member is held in place in said slot by magnetic attraction between said magnetized stop member and said soft iron rainbow bars.

5. The method of claim 1 wherein said stop member is held in said slot by spring means.

6. The method of claim 1 wherein said degree marks are placed at 2.5, 5, 10, 15, 22.5, 30, 45, 50, 60, 70 and 80 degrees.

7. In a manual pipe bending apparatus having a bender head, said bender head having an arcuate bending trough shoe having first and second ends, the improvement comprising:

said bender head having a plurality of degree marks adjacent said arcuate bending trough shoe, said bender head being formed of an iron containing metal and said stop member is formed of a magnetized metal, said stop member being held in place in said slot by magnetic attraction between said magnetized stop member and said bender head;

a slot located in the outer periphery of said arcuate bending trough shoe adjacent each of said degree marks; and a stop member located in one of said slots, said stop member adapted to contact a pipe being bent in said apparatus and provide a signal that the desired degree of bending is complete.

8. The apparatus of claim 7 including providing an electrical circuit that is connected to said stop member, to a power source and to a light bulb, and said pipe is conductive and grounded, said circuit adapted to light said light bulb upon contact between said pipe and said magnetized stop member.

9. The apparatus of claim 8 wherein said light bulb is a light emitting diode.

10. The apparatus of claim 7 including a soft iron rainbow bar located on each side of said arcuate bending trough shoe, said soft iron rainbow bar being adapted to contact said stop member in said slot whereby said stop member is held in place in said slot by magnetic attraction between said magnetized stop member and said soft iron rainbow bars.

11. The apparatus of claim 7 wherein said stop member is held in said slot by spring means.

12. The apparatus of claim 7 including a pipe lock down hook located on said bender head adjacent said first end of said arcuate bending trough shoe.

13. A manual method of bending pipe comprising:

providing a bender head having an arcuate bending trough shoe having first and second ends;

locating a pipe lock down hook on said bender head adjacent said first end of said arcuate bending trough shoe;

locating a plurality of degree marks on said bender head adjacent said arcuate bending trough shoe;

locating slots in the outer periphery of said arcuate bending trough shoe adjacent each of said degree marks;

inserting a stop member into a selected one of said slots and causing said stop member to be held in place in said slot;

selecting a length of pipe to be bent;

providing the exterior of said pipe with first and second center stripes running longitudinally thereof and parallel to the axis of said pipe, said first and second center stripes being located 180 degrees apart;

providing said pipe lock down hook with a centering groove adapted to allow alignment of one of said first and second center stripes with said centering groove;

placing a first selected portion of said length of pipe in contact with said arcuate bending trough shoe adjacent said first end thereof with one of said first and second center stripes located on the exterior of said pipe in alignment with said centering groove of said pipe lock down hook; and bending said length of pipe towards said arcuate bending trough shoe until said pipe contacts said stop member.

14. The method of claim 13 including locating a bend start arrow on said bender head adjacent said first end of said arcuate bending trough shoe.

15. The method of claim 14 including marking said pipe circumferentially with spaced apart first and second bend cross marks, aligning said first center stripe with said centering groove, aligning said first bend cross mark with said bend start arrow, bending said pipe towards said arcuate bending trough shoe until said pipe contacts said stop member, rotating said pipe 180 degrees and aligning said second center stripe with said centering groove, moving said pipe until said second bend cross mark is aligned with said bend start arrow, and bending said pipe towards said arcuate bending trough shoe until said pipe contacts said stop member.

* * * * *